US005870940A

United States Patent [19]

Kimbara

[11] Patent Number: 5,870,940

[45] Date of Patent: Feb. 16, 1999

[54] YARN TENSIONING METHOD AND DEVICE FOR TEXTILE WEAVING MACHINES

[75] Inventor: Masahiko Kimbara, Tsukuba, Japan

[73] Assignee: Three-D Composites Research Corporation, Tsukuba, Japan

[21] Appl. No.: 720,753

[22] Filed: Oct. 1, 1996

Related U.S. Application Data

[62] Division of Ser. No. 313,043, filed as PCT/JP94/00161 Feb. 3, 1994, published as WO94/18366 Aug. 18, 1994, Pat. No. 5,584,223.

[30] Foreign Application Priority Data

| | | | |
|---|---|---|---|
| Feb. 3, 1993 | [JP] | Japan | 5-39551 |
| Mar. 25, 1993 | [JP] | Japan | 5-90833 |
| Mar. 25, 1993 | [JP] | Japan | 5-90834 |
| Mar. 25, 1993 | [JP] | Japan | 5-90835 |

[51] Int. Cl.[6] ..... D04C 3/14

[52] U.S. Cl. ..... 87/56; 87/57; 87/61

[58] Field of Search ..... 87/22, 54, 55, 87/57, 61, 62, 56

[56] References Cited

U.S. PATENT DOCUMENTS

| | | | |
|---|---|---|---|
| 447,108 | 2/1891 | Fornander | 87/22 |
| 998,031 | 7/1911 | Neufeld | 87/22 |
| 1,135,702 | 4/1915 | Larson | 87/57 |
| 2,897,716 | 8/1959 | Olson | 87/57 |
| 4,903,574 | 2/1990 | Brown et al. | 87/57 |
| 5,146,836 | 9/1992 | DeYoung | 87/22 |
| 5,220,859 | 6/1993 | DeYoung | 87/57 |
| 5,285,712 | 2/1994 | Doyne et al. | 87/57 |

FOREIGN PATENT DOCUMENTS

| | | | |
|---|---|---|---|
| 483789 | 5/1992 | European Pat. Off. | 87/57 |
| 730307 | 1/1943 | Germany | 87/56 |
| 52-36062 | 8/1987 | Japan . | |
| 3-19947 | 1/1991 | Japan . | |
| 309152 | 11/1955 | Switzerland | 87/56 |

*Primary Examiner*—William Stryjewski

*Attorney, Agent, or Firm*—Oblon, Spivak, McClelland, Maier & Neustadt, P.C.

[57] ABSTRACT

A yarn tensioning device which is arranged to impart a high unwinding tension to a feed yarn in a yarn draw-out phase of operation and to impart a low unwinding tension with a large yarn draw-back capacity. The yarn tensioning device is is particularly suitable for use on a textile machine which is arranged to produce at three-dimensional fabric by inter-weaving a large number of yarns 24 fed from yarn carriers 20 which are driven by a carrier drive mechanism to shift the respective positions along predetermined loci of movements within a common carrier shifting plane. Mounted on each carrier 20 is a high tensioning mechanism which acts with a small yarn draw-back capacity and a high yarn tensioning capacity for a feed yarn 24 being unwound from a bobbin 23, in combination with a low tensioning mechanism 22 which acts on the feed yarn with a large yarn draw-back capacity and a low tensioning capacity. As a result, a high yarn tensioning force is applied to the feed yarn by the high tensioning mechanism 21 in a yarn draw-out phase of operation, and a low yarn tensioning force is applied to the feed yarn by the low tensioning mechanism 22 in a yarn draw-back phase of operation past a limit point of yarn draw-back by the high tensioning mechanism 21.

2 Claims, 10 Drawing Sheets

YARN TENSIONING METHOD AND DEVICE FOR TEXTILE WEAVING MACHINES

This is a Division of application Ser. No. 08/313,043 filed on Oct. 3, 1994 now allowed which was filed a PCT/JP94/00161 filed Feb. 3, 1994 published as WO94/18366 Aug. 18, 1994.

BACKGROUND OF THE INVENTION

1. Field of the Art

This invention relates to yarn tensioning method and device suitable for use on textile weaving machines, and more particularly to yarn tensioning method and device which can be effectively used especially on textile weaving machines for fabrication of three-dimensional braids such as square braider, magnaweave, three-dimensional braider and the like.

2. Prior Art

In case of a weaving machine which is directed to the fabrication of braid type three-dimensional fabrics as disclosed in Japanese Laid-Open Patent Application H4-41756, namely, in case of a weaving machine which is arranged to produce three-dimensional fabrics by interweaving yarns fed from a number of yarn carriers, which are driven from a carrier drive mechanism to shift the respective positions along predetermined loci of movements in a common carrier moving plane, it is necessary to provide a yarn orientation angle setting means in order to make the orientation angles of the respective yarns substantially uniform by beating actions in a stabilized manner or in order to control the yarn orientation angles arbitrarily.

The inventor of the present invention proposed an effective means for setting such orientation angles in a prior Japanese Patent Application H4-180408. In a weaving process by a braid type three-dimensional textile weaving machine without an orientation angle setting means of this sort, the greater the yarn draw-out rate in each weaving cycle of the textile to be fabricated, the smaller becomes the orientation angle of the textile. If the orientation angle becomes too small, the resulting fabric cannot be regarded as substantially three-dimensional fabric any longer.

On the other hand, in case of the above-mentioned braid type three-dimensional textile weaving machine, the yarn orientation angle in three-dimensional fabric can be increased by the use of a yarn tensioning device as disclosed in Japanese Laid-Open Patent Application H2-178176 or by the use of a yarn tensioning device as disclosed in Japanese Patent Publication H4-47054. However, a greater orientation angle is reflected by a greater yarn draw-out angle from the yarn tensioning device, so that, when a bobbin is moving away from the center of the fabric being woven, it becomes necessary to draw out the yarn by more than an amount to be consumed by the weaving operation. It follows that, when the bobbin is approaching the center of the fabric, this time there arises a necessity for drawing back the yarn toward the bobbin to take up an excess amount of yarn which would remain overfluously after consumption by weaving operation. In this regard, as will be explained below, the conventional yarn tensioning devices fail to cope with these problems to a sufficient degree.

Illustrated schematically in FIG. 16 is a typical yarn tensioning device which has been well known in the art.

This yarn tensioning device basically includes a bobbin 3 rotatably mounted on a support shaft 2 which is erected at an eccentric position on a carrier, a clutch 4 mounted on the bobbin 3 and provided with clutch claws, and a rocking lever 5 pivotally supported on the carrier 1 for rocking movements about a fulcrum point 6 in a center portion thereof and engageable at a force end portion thereof with one of the claws of the clutch 4 to block the rotation of the bobbin 3.

The yarn which is unwound from the bobbin 3 is led out through yarn guides 8, 9 and 10, of which the yarn guides 8 and 10 are fixedly located on the carrier 1 while the yarn guide 9 is provided on a slider member 13 which is slidable along a guide shaft 11 under the influence of the tension in the feed yarn against a biasing force of a tension spring 12. When the tension spring 12 is compressed by a predetermined biasing force the slider member 13 is brought into engagement with a contact member 14 which is connected to one end of the rocking lever 5, thereby releasing the bobbin 3 from the blocking action of the rocking lever 5 against biasing action of a return spring 15.

Therefore, when the feed yarn 7 from the bobbin 3 is drawn out, the tension spring 12 is compressed to a certain extent by the force which acts on the yarn, and the slider member 13 is lifted to push the contact member 14, rocking the lever 5 and turning the fore end portion of the lever 5 out of engagement with a claw of the clutch 4. As a result, the bobbin 3 is turned by one pitch of the claws of the clutch 4, lowering the tension in the feed yarn to a slight degree. Therefore, the slider member 13 is returned under the influence of the biasing force of the tension spring 12, and the rocking lever 5 is also returned under the influence of the biasing force of the return spring 15 to block the rotation of the bobbin 3 again by engagement with the clutch 4.

In this connection, it is known in the art that a pendant weight can be employed in substitute for the above-described tension spring 12 to apply a biasing force to the yarn 7 in a similar manner.

The above-described conventional device makes it possible to cope with fabrics involving large yarn draw-out angles, although it relies on the action of the same tensioning mechanism in both yarn draw-out and draw-back phases of operation, applying substantially the same tensioning force on the yarn in the yarn draw-out and draw-back phases of operation. However, the yarn draw-out phase requires a force for disengaging the lever 5 from a claw of the clutch 4 in contrast to the yarn draw-back phase which does not, so that in average there is a tendency of the tension in the feed yarn becoming slightly higher in the yarn draw-out phase than in the yarn draw-back phase of operation.

On the other hand, on a braid-type three-dimensional fabric weaving machine, for example, the fabric and yarns are in the relationship as schematically shown in FIG. 17. As seen in this figure, a fabric weaving process involves yarns 7*a* which are tensioned in a direction of densifying the fabric and yarns 7*b* (indicated by bald lines) which are tensioned in a direction of undensifying the fabric. The yarns which are tensioned in the densifying direction are the yarns which are drawn out or wound off from the bobbins on outward bobbin movements away from the center of the fabric, while the yarns which are tensioned in the undensifying direction are the yarns which are drawn back or rewound toward the bobbins on inward bobbin movements toward the center of the fabric. Therefore, if arrangements are made to apply different tensioning forces to the yarns in these two different phases of operation, namely, to apply a high tensioning force to the yarns in a draw-out phase and to apply a low tensioning force to the yarn in a draw-back phase, it becomes possible to increase the orientation angle all the more for densification of the fabric utilizing the beating effects of the highly tensioned feed yarns.

However, it is difficult to increase the yarn orientation angle especially in case of a yarn tensioning device of the arrangements as shown in FIG. 16, in which substantially a constant tensioning force is applied to the yarn throughout the yarn draw-out and draw-back phases of a weaving operation.

Besides, from the standpoint of increasing the amount of the yarn winding on the bobbin 3 and suppressing fluctuations in yarn tensioning force as caused by movements of the yarn carrier 1 durig a weaving operation the yarn guide 10, which serves to withdraw the yarn from the bobbin 3, is most desirably located above a bobbin support shaft which is erected at the center of the carrier 1. However, according to the known yarn tensioning device shown in FIG. 16, the bobbin support shaft 2 is located in an eccentric position relative to the center line of the carrier for the purpose of locating the bobbin and yarn tensioning device in such spaces on the carrier as would keep them out of contact with bobbins and yarn tensioning devices on other approaching carriers. while locating the yarn tensioning device in a position which would not interfere with the operation of replacing the bobbin for yarn replenishment.

The location of the bobbin 3 in an eccentric position as in the above-described prior art arrangement requires to minimize the bobbin diameter in a degree commensurate with its eccentricity despite a corresponding reduction in size of the yarn winding on the bobbin. In addition, the location of the yarn tensioning device at one side of the bobbin ensures easy mounting and dismantling of the bobbin at the time of its replacement. However, since the yarn 7 is withdrawn from a position deviated from the center of the carrier 1, there is no guarantee that a predetermined tensioning force is constantly exerted on the yarn 7 without influenced by the movements of the carrier which is shifted and turned in step with with the progress of a weaving process In this regard, it would be the best choice to mount the yarn tensioning device on a bobbin support shaft 2 which is erected at the center of the yarn carrier 1, and to withdraw a yarn 7 from a bobbin 3 through a yarn guide 10 which is located over the bobbin support shaft 2 at the center of the carrier 1. In such a case, however, there arises a necessity for providing suitable means which would facilitate the mounting and dismantling of the bobbin 3 at the time of its replacement. In case of a textile weaving machine which is arranged to weave three-dimensional textiles like 3-D braids by driving a large number of yarn carriers in a carrier shifting plane, the yarn tensioning device on each carrier are required to be smaller in size and diameter, and this makes the bobbin mounting and dismantling operations more difficult.

SUMMARY OF THE INVENTION

It is a primary object of the present invention to provide yarn tensioning method and device which facilitate the production of three-dimensional fabrics with a large yarn orientation angle as mentioned above, imparting a higher tension to the feed yarn in a yarn draw-out phase of a weaving operation and a lower tension to the feed yarn in a yarn draw-back phase with a large yarn draw-back capacity.

It is another object of the present invention to provide yarn tensioning method and device suitable for use on a textile weaving machine which is arranged to produce a three-dimensional fabric by interweaving a large number of yarns on yarn carriers which are driven by a carrier drive mechanism to shift their positions along predetermined loci of movements within a common carrier shifting plane, the yarn tensioning method and appratus including means for producing beating effects in a favorable manner to increase the yarn orientation angle of the fabric.

It is still another object of the present invention to provide yarn tensioning method and device which, in addition to the beating effect which permits to increase the yarn orientation angle of fabrics, are capable of suppressing the degree of yarn fluffing, which would take place at the time of yarn draw-back through a large bending angle, by lowering the tension in the feed yarn in the yarn draw-back phases.

It is a further object of the present invention to provide yarn tensioning method and device, which employ a high tensioning mechanism and a low tensioning mechanism on a yarn carrier, applying a high tension to the yarn by the high tensioning mechanism in a yarn draw-out phase of a weaving operation and applying a low tension to the yarn by the low tensioning mechanism in a yarn draw-back phase past a limit point of yarn draw-back by the high tensioning mechanism.

It is a further object of the invention to provide a yarn tensioning device having a support member for the high tensioning mechanism easily detachably mounted on an upper end portion of a bobbin support shaft erected at the center of a carrier, or having the bobbin support shaft easily detachably planted on the carrier, thereby facilitating the replacement of the bobbin while ensuring stabilized weaving operations.

It is another object of the invention to provide a yarn tensioning device which permits adjustments of feed yarn tensioning force of the high tensioning mechanism by the use of a simple means and in such a way that one can check the adjusted tension level easily from outside by eye observation.

It is still another object of the invention to provide a yarn tensioning device which is arranged to maintain the baising force of a return spring of the low tensioning mechanism substantially at a constant level in a stabilized manner.

It is a further object of the invention to provide a relatively trouble-free yarn tensioning device which is simple and compact in construction and which an impart tension to a feed yarn substantially constantly, with ability to draw back the yarn to such an extent as will be necessary for preventing slackening of the yarn.

In accordance with the present invention, for achieving the above-stated objectives, there is provided a yarn tensioning method for a textile weaving machine of the type which is arranged to weave a three-dimensional fabric by interweaving a number of yarns fed from a corresponding number of yarn carriers, which yarn carriers being driven by a carrier drive mechanism to shift the respective positions along predetermined loci of movements within a common carrier shifting plane, the method comprising the steps of: providing on each yarn carrier a high tensioning mechanism with a small yarn draw-back capacity and a high yarn tensioning capacity relative to a feed yarn being withdrawn from a bobbin on the carrier to impart a high unwinding tension thereto; providing between the carrier and bobbin a low tensioning mechanism with a large yarn draw-back capacity and a low yarn tensioning capacity relative to the bobbin through a rotational coupling therewith, the high tensioning mechanism imparting a high tension to the yarn in a yarn unwinding phase of operation and the low tensioning mechanism taking over the high tensioning mechanism to impart a low tension to the yarn in a yarn rewinding phase of operation at a limit point of yarn draw-back by the high tensioning mechanism.

In accordance with the present invention, there is also provided a yarn tensioning device for a textile weaving machine of the type which is arranged to weave a three-dimensional fabric by interweaving a number of yarns fed from a corresponding number of yarn carriers, which yarn carriers being driven by a carrier drive mechanism to shift the respective positions along predetermined lock of movements within a common carrier shifting plane, the yarn tensioning device comprising: a high tensioning mechanism mounted on each yarn carrier and arranged to act with a small yarn draw-back capacity and a high yarn tensioning capacity relative to a feed yarn being withdrawn from a bobbin on the carrier to impart a high unwinding tension thereto; a low tensioning mechanism mounted between the carrier and bobbin and arranged to act with a large yarn draw-back capacity and a low yarn tensioning capacity relative to the bobbin through a rotational coupling therewith; the high tensioning mechanism being adapted to impart a high tension to the feed yarn in a yarn unwinding phase of operation, and the low tensioning mechanism being adapted to take over the high tensioning mechanism to impart a low tension to the yarn in a yarn rewinding phase of operation at a limit point of yarn draw-back by the high-tensioning mechanism.

In a preferred form of the invention, the high tensioning mechanism of the yarn tensioning device is constituted by: a support member mounted on a bobbin support shaft on the carrier; a yarn tensioning lever pivotally supported on the support member and provided with a claw to be brought into and out of engagement with one of claws of a clutch on the bobbin; a yarn guide provided at one end of the yarn tensioning lever in such a way as to rock the yarn tensioning lever in a direction of disengaging the claw from the clutch when the tension in the feed yarn reaches a predetermined level; and a high tensioning means arranged to act on the other end of the tension lever to impart a high tension to the feed yarn. For example, the high tensioning means may employ a tension spring which is charged to exert a biasing force on the other end of the tension lever.

The low tensioning mechanism of the above-described yarn tensioning device can be constituted by: a spring chamber formed around the bobbin support shaft on the yarn carrier; a spiral return spring accommodated in the spring chamber and having the inner end thereof fixedly secured to a bobbin connecting member rotatably fitted on the bobbin support shaft and the outer end thereof held in engagement with the inner periphery of the spring chamber through male and female coupling members which are disengaged from each other when the spiral return spring is wound up to a smaller diameter beyond a predetermined limit point and engaged with each other again upon the spiral return spring being recoiled into a larger diameter.

With the yearn tensioning device of the above arrangements, in a yarn draw-out phase of operation, the yarn tensioning lever of the high tensioning mechanism is rocked by the action of the tensioned feed yarn which is threaded through the yarn guide on the tensioning lever, and, as soon as the yarn is unwound over a length in excess of an absorption capacity of the tensioning lever, the claw on the lever is disengaged from the clutch member on the bobbin, permitting the bobbin to be turned under the influence of the tension in the feed yarn to wind off the yarn therefrom. The tension in the feed yarn drops as it is wound off, and consequently the tensioning lever is allowed to return and to bring its claw again into engagement with the clutch to block the rotation of the bobbin. Accordingly, by the balancing actions between the tension in the feed yarn and the biasing force of the tension spring, the feed yarn is constantly imparted with a high tension commensurate with the spring force.

While the yarn is fed out under the control of the high tensioning mechanism, the spiral return spring of the low tensioning mechanism is wound up by the rotation of the bobbin, and, as soon as the spring winding reaches a limit point, the male and female coupling members on the outer end of the return spring and the inner periphery of the spring chamber are disengaged from each other and then engaged with each other again in a shifted position in the rotational direction of the bobbin.

In a yarn draw-back phase where the excess yarn is wound back onto the bobbin, the claw on the yarn tensioning lever comes into abutment against the clutch on the bobbin as a result of a drop in yarn tension, exerting a slight rewinding force on the yarn and thereafter breaking the balancing relationship between the tension spring and the yarn tension. Therefore, the yarn is now rewound in a balanced state relative to the torque which is applied to the bobbin by the spiral return spring.

In this manner, by effectively combining a high tensioning mechanism, which has a small yarn draw-back capacity and a large tensioning capacity for the feed yarn, with a low tensioning mechanism, which has a large draw-back capacity and a small tensioning capacity, the yarn tensioning device of the invention makes it possible to weave three-dimensional fabrics of large yarn orientation angles easily by imparting a high tension to the feed yarn in a yarn draw-out phase of weaving operation and imparting a low tensioning a yarn draw-back phase after a limit point of yarn draw-back by the high tensioning mechanism.

Further, in the above-mentioned yarn tensioning device, preferably the bobbin is rotatably fitted on a bobbin support shaft which is erected at the center of the yarn carrier, and a support member is non-rotatably and detachably mounted on an upper end portion of the bobbin support shaft the support member having a yarn guide for the yarn to be wound off the bobbin and fed upward of the bobbin support shaft. The support member can be set in position on the bobbin support shaft through a joint structure including a socket cavity in a lower end portion of the support member, a setting pin radially fixed within the socket cavity, and an expansion slot formed into the upper end of the bobbin support shaft, the expansion slot having a width smaller than the diameter of the setting pin and being formed with grooves on its confronting inner surfaces to receive and hold the setting pin therebetween in a resiliently gripped state when the support member is press-fitted on the bobbin support shaft.

Further, the support member may be set in position on the bobbin support shaft through a joint structure including a socket cavity formed in a lower end portion of the support member a resilient pin fitted in and across the socket cavity, and a groove formed on a lateral side of the bobbin support shaft to receive and hold the resilient pin therein in a resiliently pressed state when the support member is press-fitted on the bobbin support shaft.

With these arrangements, upon press-fitting the socket cavity of the support member on a head end portion of the bobbin support shaft, either the head end portion of the bobbin support shaft or the resilient pin the socket cavity of the support member undergoes resilient deformation to let the pin in the socket cavity drop into the groove or grooves in the head end portion of the bobbin support shaft, permitting to connect the two parts easily and detachably and to replace the bobbin in a facilitated manner despite the location of the support member at the upper end of the bobbin support shaft. Besides, since the pin member in the socket cavity and the head end portion of the bobbin support shaft are resiliently pressed to each other, the support member can be connected in a restricted state against movements in axial and rotational directions relative to the bobbin support shaft.

On the other hand, from a standpoint of easy bobbin relacements, there may be employed an arrangement including a bobbin support shaft erected non-rotatably at the center of a yarn carrier, a bobbin rotatably fitted on the bobbin support shaft, and a support member mounted at the upper end of the bobbin support shaft and having a yarn guide for a feed yarn to be unwounded from the bobbin and fed out upward of the bobbin support shaft. In this case, the bobbin support shaft is preferably mounted on the yarn carrier through a joint structure including a receptacle hole formed in the carrier, a U-pin fitted across the receptacle hole, a tapered foot portion formed at the lower end of the bobbin support shaft to spread apart the U-pin when fitted into the receptacle hole, and a recessed portion provided immediately above the tapered foot portion to nest the U-pin therein, the bobbin support shaft being held in a resiliently pressed state at the recessed portion by the U-pin.

In this case, the bobbin can be removed from the yarn carrier together with the bobbin support shaft and the support member of the high tensioning mechanism to facilitate the operation of threading the yarn through yarn guides in a preparatory stage of operation or at the time of bobbin replacement.

The high tensioning mechanism of the above-described yarn tensioning device may be constituted by a tension spring fitted on a guide shaft mounted on the support member on the bobbin support shaft and between one end of a yarn tensioning lever and a spring holder provided on the guide shaft, the guide shaft having a number of stopper grooves at suitable intervals along the length thereof and the spring holder being adjustably fixed in one of the stopper grooves by means of a resilient ring member, thereby permitting to adjust the biasing force of the tension spring acting on one end of the tensioning lever.

In this case, the biasing force of the tension spring of the high tensioning mechanism can be adjusted by setting the spring holder in a stopper groove at a suitable position on the guide shaft. This arrangement not only facilitates the adjustment of the tension in the feed yarn, but also makes it possible to check the adjusted position of the spring holder from outside by eye observation.

Further, the low tensioning mechanism of the above-described yarn tensioning device may employ a spiral return spring which is constituted by an inner spring member of lower rigidity and an outer spring member of higher rigidity which is connected to the outer end of the inner spring member.

In case of a low tensioning mechanism with such a spring arrangement, as the return spring is wound up into a smaller diameter at the time of winding off the feed yarn, the loops of the inner spring member of lower rigidity are deformed and tightened up relatively easily compared with the loop or loops of the outer spring member of higher rigidity which cannot be constructed into a smaller diameter through deformation until the tightening force on the return spring is magnified to a certain level. Therefore, it is only after the return spring as a whole has been wound up and tightened to a sufficient degree that the male and female coupling members on the outer end of the spring and the inner periphery of the spring chamber are disengaged from each other, thereby maintaining the biasing force of the return spring substantially at a constant level in a stabilized manner.

BEST MODE FOR CARRYING OUT THE INVENTION

Hereafter, the yarn tensioning method and device according to the invention are described more particularly b way of its preferred embodiments of the yarn tensioning device. Needless to say, various alterations and modifications can be added to this invention without departing from its technical scope as defined in the appended claims.

Referring to FIGS. 1 to 4, there is shown an embodiment of the yarn tensioning device according to the present invention.

Figure 1:
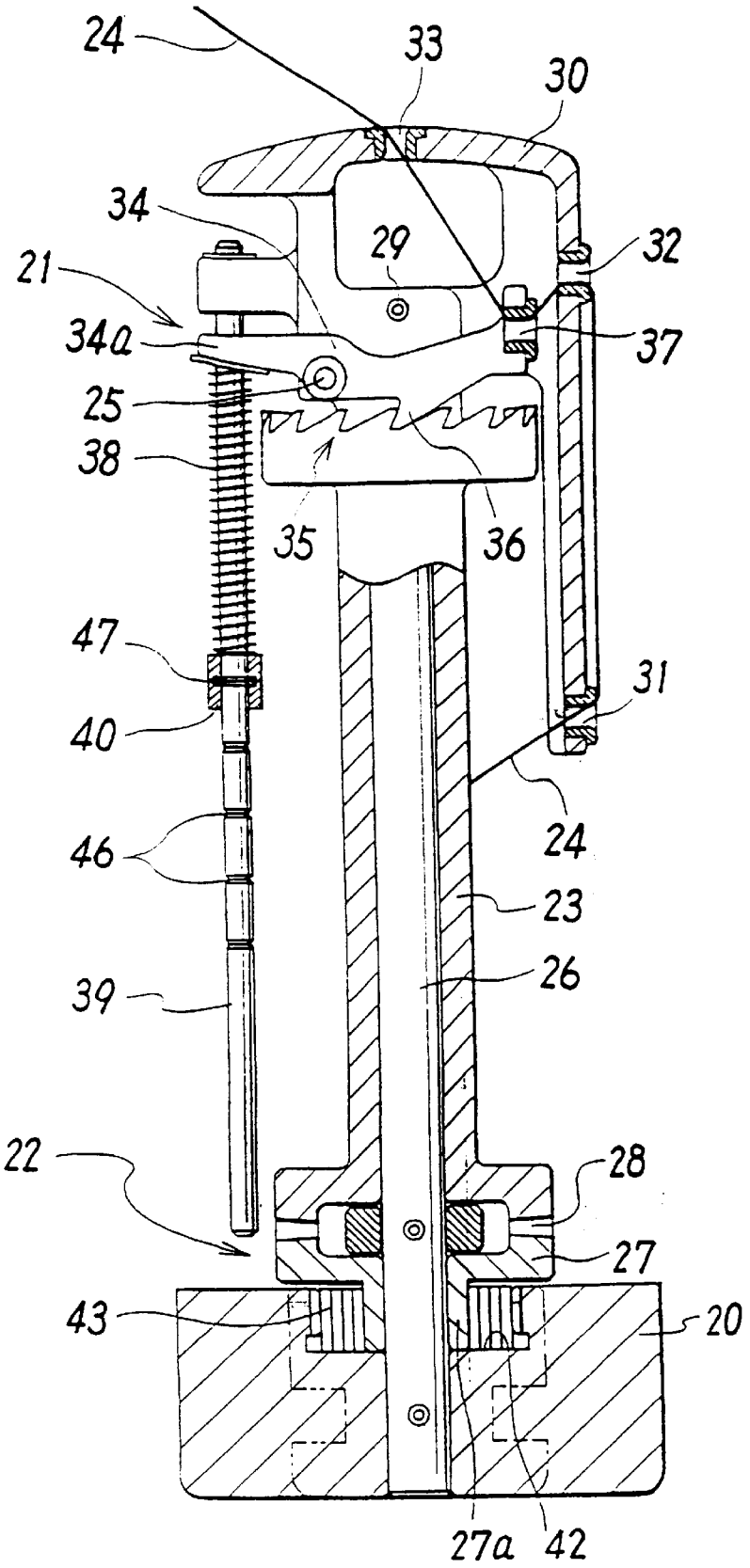
FIG. 1 is a sectioned side view of an embodiment of the yarn tensioning device according to the present invention.
Figure 2:
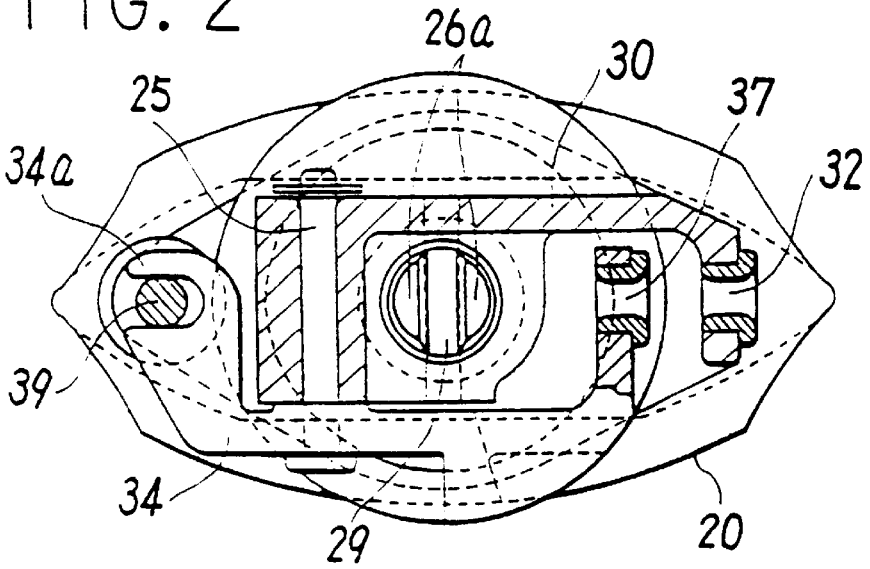
FIG. 2 is a partly cutaway plan view of the yarn tensioning device.

This yarn tensioning device can be effectively used on a textile weaving machine which is arranged to produce a braid type three-dimensional fabric (as disclosed in Japanese Laid-Open Patent Application H4-41756) by interweaving a large number of yarns fed from bobbins on yarn carriers 20 which are driven by a carrier drive mechanism to shift the respective positions along predetermined loci of movements within a common carrier transfer plane. Each carrier 20 is constructed to have a structure which is suitable for travel along a predetermined loci of movements. In this instance, as shown particularly in FIGS. 3 and 4, each carrier 20 has a spindle-shaped structure to be gripped between a pair of rotors. FIG. 1 shows by two-dot chain line the sectional shape of the carrier taken in a direction vertical to the face of the drawing.

More specifically, the yarn tensioning device includes a high tensioning mechanism 21 which is arranged to have a small yarn draw-back capacity and a large feed yarn tensioning capacity, and a low tensioning mechanism 22 which is arranged to have a large yarn draw-back capacity and a small feed yarn tensioning capacity, the two mechanisms controlling a bobbin 23 cooperatively in such a manner as to impart a high tension to a feed yarn 24 in a yarn draw-out phase of weaving operation and to impart a low tension in a yarn draw-back phase past a limit point of high tension yarn draw-back.

In order to control the tension in the feed yarn in this manner, a bobbin support shaft 26 is erected at the center of the carrier 20, and a bobbin 23 carrying a winding of yarn 24 is rotatably fitted on the support shaft 26. The bobbin 23 is supported on and disengageably coupled with a bobbin connecting member 27 of a low tensioning mechanism 22, which is provided between the bobbin 23 and the carrier 20, through respective intermeshing claws 28 which are engaged with each other in such a manner as to block relative rotations. A support member 30 of a high tensioning mechanism 21 is connected to the upper end of the above-mentioned support shaft 26 by a fixing pin 29.

The support member 30 of the high tensioning mechanism 21 is provided with a yarn guide 31 which is located at the lower end of a pendant wall portion hanging around the circumference of the bobbin 23 for guiding a yarn 24 being unwound from the bobbin 23, a yarn guide 32 which is arranged to guide the yarn 24 at a position above a yarn tensioning lever 34 on the support member 30, and an exit yarn guide 33 for guiding the outgoing yarn 24 at the top end of the support member 30 above a center point of the carrier 20.

The above-mentioned yarn tensioning lever 34 is rockably supported on the support member 30 through a pin 25 in its intermediate portion, and provided with a claw 36 to be brought into and out of engagement with one of claws of a clutch 35 on the end face of the bobbin 23 by rocking movements of the tensioning lever 34. Further, the tensioning lever 34 is provided with a yarn guide 37 at its fore end in face to face relation with the afore-mentioned yarn guide 32, the yarn guide 37 being located in a position slightly lower than the yarn guide 32 when the claw 36 is in engagement with a claw of the clutch 35. Pressed against the other end of the tensioning lever 34 is a tensioning spring 38 thereby to apply a high tensioning force to the yarn 24.

The tensioning spring 38 is charged between a spring holder 40, which is retained on a fixed guide shaft 39 on the support member 30, and a bifurcated end portion 34*a* of the tensioning lever 34 loosely holding the guide shaft 39 therebetween. The tensioning spring 38 is so arranged as to permit adjustments of its tensioning force acting on the tensioning lever 34 arbitrarily almost to any level as will be described hereinlater, but its draw-back capacity is relatively small because it can draw back the yarn 24 only within the range of rocking movement of the lever 34.

The yarn guide 37, which is provided at the fore end of the tensioning lever 34, functions to let the yarn 24 in the yarn guide 37 rock the lever 34 and disengage the claw 36 of the lever 34 from a claw on the clutch 35 when a tension of a predetermined level develops in the yarn 24 which is being withdrawn through the yarn guide 32 and led out through the yarn guide 33 via yarn guide 37. For this purpose, the yarn guide 32 on the support member 30, the yarn guide 37 on the lever 34 and the yarn guide 33 on the support member 30 are so arranged as to hold in V-shape the yarn 24 which is threaded through these yarn guides.

Figure 9:
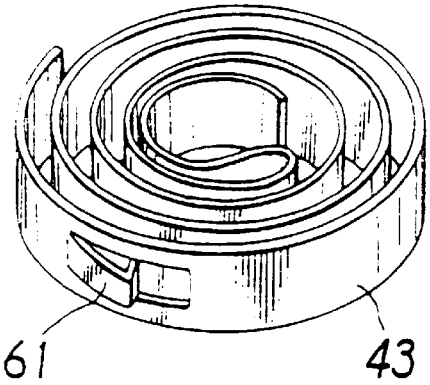
FIG. 9 is a perspective view showing the arrangement of a return spring of the low tensioning mechanism.

On the other hand, the low tensioning mechanism 22 is provided between the carrier 20 and the bobbin 23. More specifically, as shown in particularly in FIGS. 1, 3 and 4, the carrier 20 is provided with an annular spring chamber 42 around the vertically planted support shaft 26. The spring chamber 42 accommodates therein a spiral return spring 43 as will be described hereinlater with reference to FIG. 9. The inner end of the return spring 43 is fixed to a sleeve portion 27*a* of the bobbin connecting member 27, which is rotatably fitted on the centrally located support shaft 26, while a hook 44 at the outer end of the spring 43 is held in engagement with one of notches 45 which are provided at suitable intervals on the inner peripheral surface of the spring chamber 42.

When the return spring 43 is wound up on and around the sleeve portion 27*a* of the bobbin connecting member 27 by rotation of the bobbin 23 and bobbin connecting member 27 at the time of feeding out the yarn 24, it applies a rewinding force to the bobbin 23 through the bobbin connecting member 27. As the return spring 43 is wound up, its loops are contracted in diameter through deformation, causing the hook 44 to disengage from a notch 45 and to engage with a next notch 45 on the inner periphery of the spring chamber 42 thereby restoring and maintaining substantially a constant tensile force in the return spring 43.

In a yarn draw-out phase of operation, the yarn tensioning device of the above-described arrangements firstly puts the high tensioning mechanism 21 in action to impart high tension to the feed yarn 24. More specifically, as the yarn 24 on the bobbin 23 is drawn out through the yarn guides 31 and 32 on the support member 23 and the yarn guide 37 on the lever 34, the tensioning lever 34 is rocked by the tension in the yarn 24 against the biasing force of the tensioning spring 38. As soon as the yarn feed length exceeds a limit of absorption length of the tensioning lever 34, the claw 36 of the lever 34 is disengaged from a claw of the clutch 35 on the bobbin 23, which is as a result rotated by the tension in the yarn 24 (in the counterclockwise direction in FIG. 2) to wind off the yarn 24. This rotation of the bobbin 23 lowers the tension in the yarn 24, permitting the tensioning lever 34 to return and bringing its claw 36 into engagement with a claw on the clutch 35 again to block the rotation of the bobbin 23. Accordingly, a high tension commensurate with the force of the tensioning spring 38 is constantly imparted to the yarn 24 by the balancing actions between the spring 38 and the tension in the feed yarn 24.

Due to the nature of its construction, the high tensioning mechanism 21 can easily increase the draw-out or unwinding tension of the yarn 24 over a broad range but has only a limited draw-back capacity.

Figure 3:
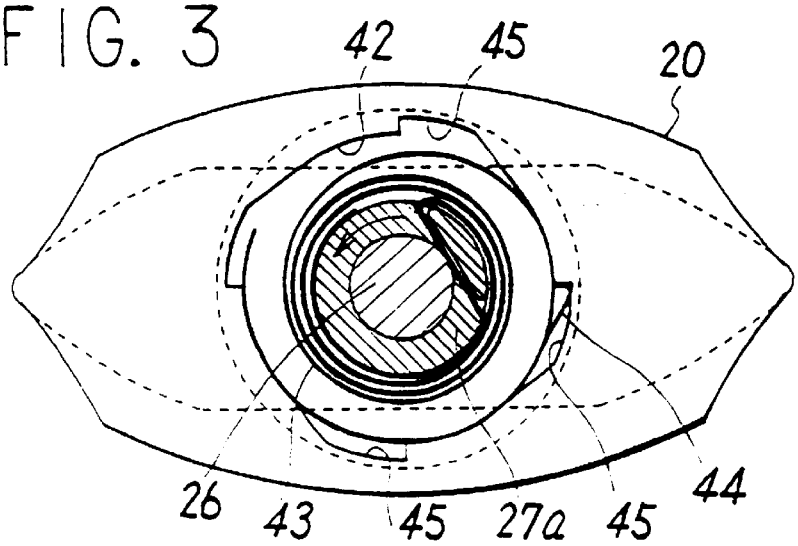
FIG. 3 is a transverse section through a low tensioning mechanism of the same embodiment.

While the yarn 24 is drawn out by the operation of the high tensioning mechanism 21 of the above arrangements, the bobbin 23 and the bobbin connecting member 27 are rotated in the arrowed direction in FIG. 3, winding up the return spring 43 of the low tensioning mechanism 22 on the sleeve portion 27*a* of the coupling member 27. It follows that the return spring 43 acts on the bobbin 23 conversely in the direction of rewinding the yarn. As the return spring 43 is wound up tighter, its loops gradually shrink into a smaller diameter until a limit point of srping winding is reached. Past the limit point, the return spring 43 is caused to shrink even at its outermost loop by further winding from the position of FIG. 3, so that the hook 44 at the out end of the return spring 43 is disengaged from a notch 45 on the inner peripheral surface of the spring chamber 42 and shifted in the rotational direction of the bobbin to engage with an ensuing notch. Consequently, the tensile force which is imparted to the yarn 24 by the return spring 43 through the coupling member 27 and bobbin 23 is maintained substantially at a constant level.

The tension to be applied to the yarn 24 by the return spring 43 of the low tension mechanism 22 is preset at a lower level than the tension which is applied by the tensioning spring 38 of the high tension mechanism 21. Due to the nature of the construction using the sprial return spring 43, the low tensioning mechanism 22 can afford a sufficiently large draw-back rate for the yarn 24 as compared with the high tensioning mechanism 21.

In a yarn draw-out phase, the claw 36 of the tensioning lever 34 on the high tensioning mechanism 21 is repeatedly urged into and out of engagement with the claws on the clutch 35, keeping the yarn 24 off the tensioning action of the low tensioning mechanism 22.

When drawing back a slackening excess yarn portion onto the bobbin 23, the claw 36 of the tensioning lever 34 of the high tensioning mechanism 21 is urged into engagement with a claw on the clutch 35 under the influence of the biasing force of the tensioning spring 38 due to a drop in tension of the yarn 24, as a result breaking the balancing relationship between the tensioning spring 38 and the tension in the feed yarn. In the meantime, the yarn 24 is drawn back by the tensioning lever 34 at a small draw-back rate. In case there still exists slackening in the yarn even after the small draw-back, the yarn 24 now comes into balancing relation with the torque which is exerted on the bobbin 23 by the return spring 43 of the low tensioning mechanism 22, and wound back toward the bobbin 23 by that torque. Namely, in a yarn draw-back phase of operation, the low tensioning mechanism 22 takes over the control of the yarn tensioning at a draw-back limit point of the high tensioning mechanism 21.

The biasing force which is applied on the tensioning lever 34 by the spring 38 is suitably adjustable by way of a simple mechanism. More specifically, as shown in FIG. 1, the guide shaft 39, which is fixed on the support member 30 of the high tensioning mechanism 21, is provided with a large number of grooves 46 at suitable intervals along it slength for adjustably fixing the spring holder 40 for the tensioning spring 38. The spring holder 40 is adjustably anchored in arbitrary one of the grooves 46 through a resilient ring 47. Therefore, the biasing force of the tensioning spring 38 which acts on an end portion of the lever 34 can be adjusted by altering the position of the spring holder 40.

Figure 5:
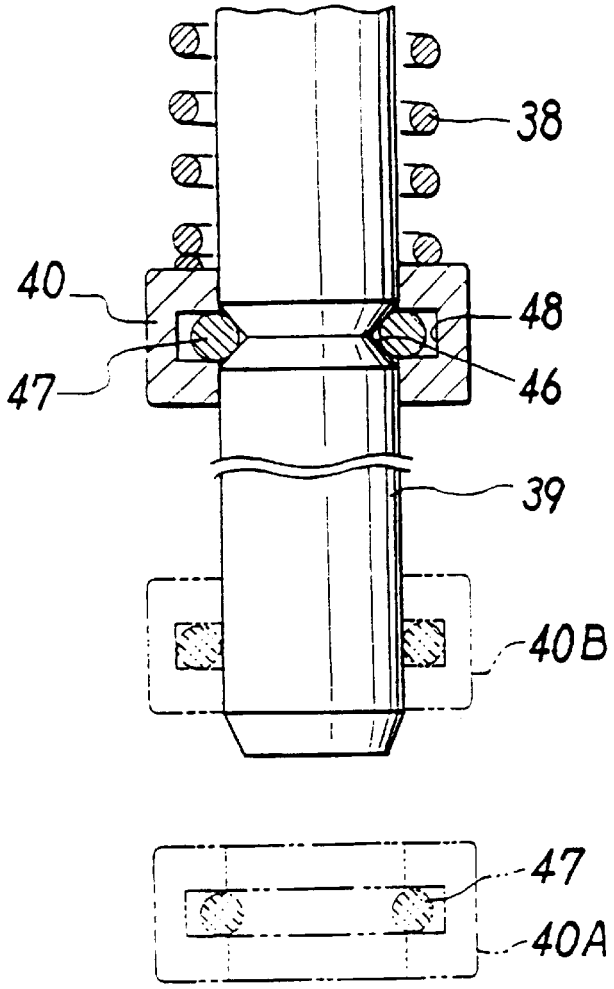
FIG. 5 is a fragmentary sectional view of a tension adjusting mechanism of the same embodiment.

FIG. 5 more particularly illustrates the construction and procedures for removably fitting the spring holder 40 at a desired position on the guide shaft 39. In order to mount the spring holder 40 in one of the grooves 46 on the guide shaft 39 by the use of the resilient ring 47, for example, the spring holder 40, which has the resilient ring 47 fitted in an annular groove 48 on its inner periphery as indicated by chain line in FIG. 5, is press-fitted onto the lower end of the guide shaft 39 and simply shifted along the guide shaft 39 in press-fit engagement therewith until the resilient ring 47 falls into a groove 46 at a desired position.

Figures 6A, 6B, 6C:
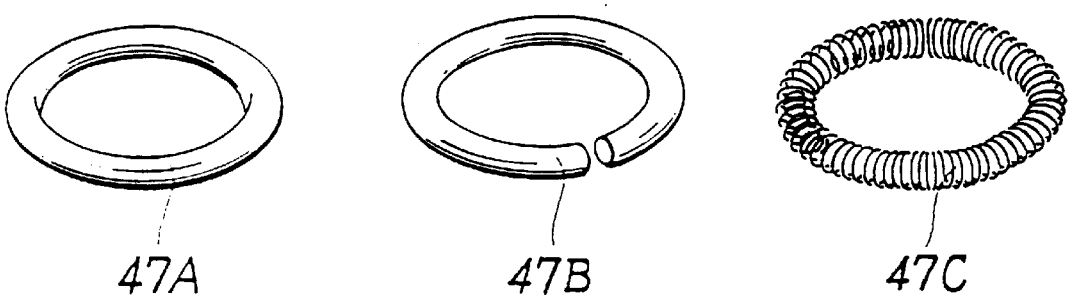
FIGS. 6A to 6C are perspective views showing examples of resilient rings for the tension adjsuting mechanism.

The resilient ring 47 may be a ring 47A in the form of an O-ring of resilient material like rubber as exemplified in FIG. 6A, a resilient metal ring 47B with a gap portion as exemplified in FIG. 6B, or a coil ring 47C formed by threadedly connecting opposite ends of a coil spring as exemplified in FIG. 6C.

In order to adjust the biasing force of the tension spring 38 of the high tensioning mechanism 21, the spring holder 40 on the guide shaft 39 is simply shifted therealong and fixed in a groove 46 of a suitable position through the resilient ring 47. By so doing, the distance between the bifurcated fore end 34*a* of the tensioning lever 34 and the spring holder 40 on the guide shaft 39, which compressively hold the tension spring 38, can be varied for the purpose of arbitrarily adjusting the biasing force of the tensioning spring 38 acting on the fore end of the tensioning lever 34.

This arrangement is advantageous in that the adjusted position of the spring holder 40 indicative of the biasing force of the tensioning spring 38 or the degree of the yarn tensioning force can be checked from outside by eye observation whenever necessary.

In place of the above-described arrangement using the tensioning spring 38, the high tensioning mechanism 21 may employ a brake, a weight spindle or various other tensioning means which have thus far been known in the art.

The support member 30 of the high tensioning mechanism 21 is arranged to support the whole mechanism except the bobbin 23 which is fittingly mounted on the bobbin support shaft 26 on the carrier 20. Therefore, if the support member 30 is arranged to be detachable easily from the upper end of the boobin support shaft 26, it becomes possible to replace the bobbin 23 in an extremely facilitated manner.

Figure 7A:
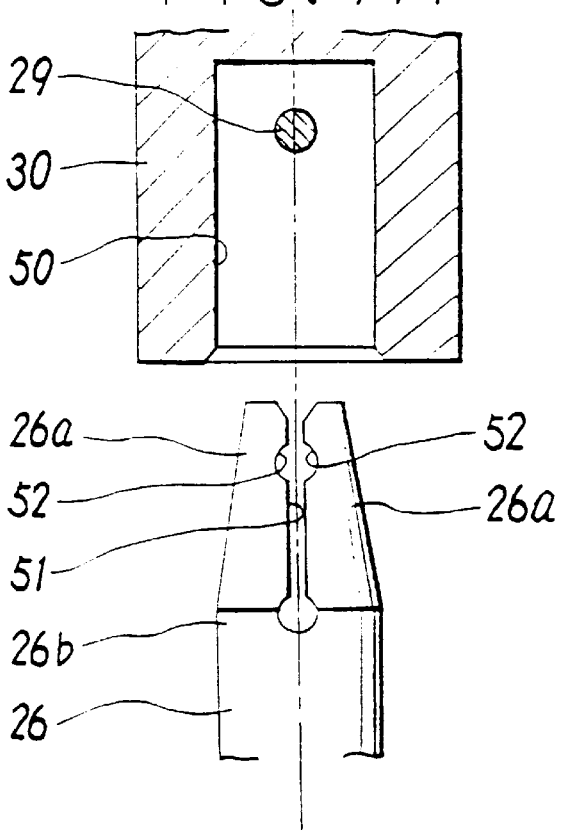
FIGS. 7A to 7C are fragmentary sectional views showing, in a sequential order, the procedures of coupling a support member of a high tensioning mechanism with a bobbin support shaft.
Figure 7B:
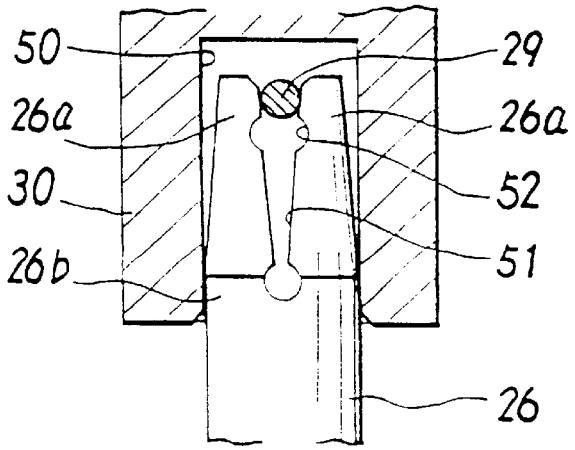
Figure 7C:
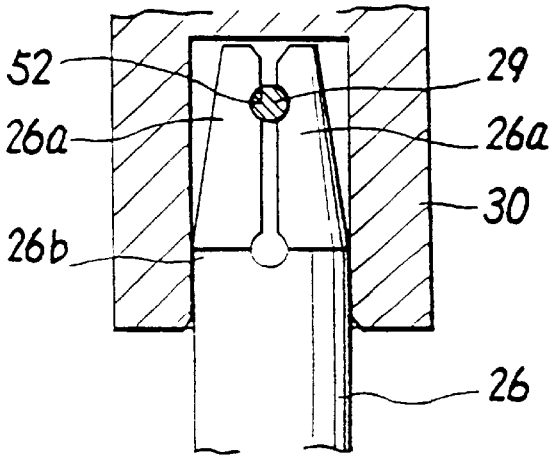

According to the invention, in order to mount the support member 30 detachably on the bobbin support shaft 26 the support member 30 is provided with a socket cavity 50 which is configured to receive the bobbin support shaft 26 therein, and a setting point 29 which is bridged across the socket cavity 50 perpendicularly to the axis of the latter as shown particularly in FIGS. 7A to 7C. On the part of the bobbin support shaft 26, an expansion slot 51 of a width slightly smaller than the diameter of the setting pin 29 is formed in its tapered head portion, the expansion slot 51 having grooves 52 on its opposingly confronting inner surfaces for fitting engagement with the setting pin 29. These grooves 52 are arranged to nest therein the setting pin 29 which resilient spreads apart the split head portion 26*a* of the support shaft 26 to a slight degree when the latter is pushed into the socket cavity 50. It follows that the setting pin 29 is held in the grooves 52 in a resiliently gripped state by the split head portion 26*a* of the support shaft 26. Besides, the circumferential surface of the split head portion 26*a* is tapered to permit its ealstic deformation at the time of insertion. However, for the purpose of preventing loose movements of the bobbin support shaft 26 within the socket cavity 50, the base portion 26*b* of the split head portion 26*a* is tightly fitted in the socket cavity 50 when in a fully inserted state.

It may be mentioned that various types of pins can employed for the above-described setting pin 29, including for example an ordinary rod-like pin and a hollow pin with a slit in part of its body in such a manner as to permit variations in diameter through resilient deformation of the setting pin itself.

As will be described step by step later on the reference to FIGS. 7A to 7C, the support member 30 of the high tensioning mechanism 21 can be mounted on the bobbin support shaft 26 simply by press-fitting the socket cavity 50 of the support member 30 on the split head portion 26*a* of the bobbin support shaft 26. In doing so, the head portion 26*a* of the bobbin support shaft 26 undergoes resilient deformation as it is fitted into the socket cavity 50 as shown in FIG. 7B, and the setting pin 29 in the socket cavity 50 drops into the paired grooves 52 as shown in FIG. 7C to connect the support member 30 and the bobbin support shaft 26 together. In this instance, the head portion 26*a* of the bobbin support shaft 26 is resiliently pressed against the setting pin 29 in the socket cavity 50 thereby stably restricting the movements of the support member 30 relative to the bobbin support shaft 26 in the axial and rotational directions.

The tension controller 21 can be removed from the bobbin support shaft 26 at the time of replacement of the bobbin 23 or on other occasions simply by pulling and lifting upward the support member 30 of the tension controller. It follows that, even though the yarn tensioning device has the bobbin support shaft 26 erected at the center of the carrier 20, the bobbin 23 can be replaced easily upon removal of the support member 30 without using a tool or the like.

Figure 8:
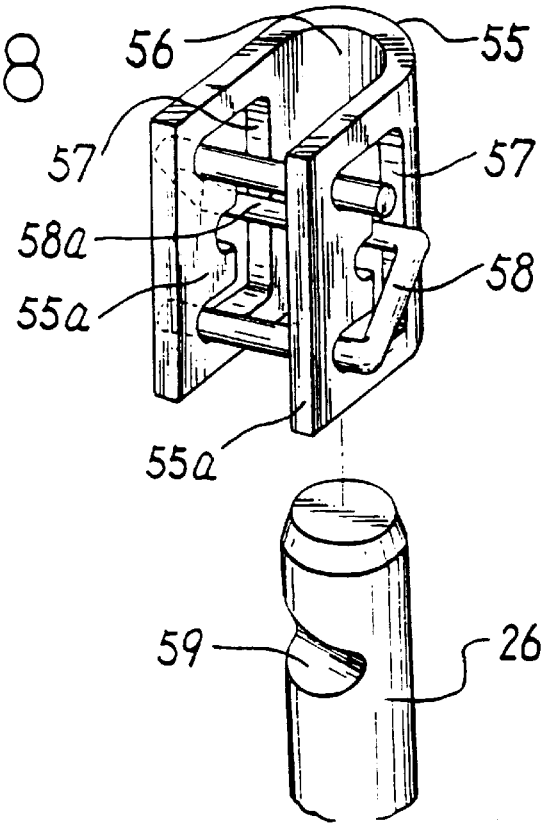
FIG. 8 is a perspective view of a joint of modified construction which couples the bobbin support shaft with the support member of the high tensioning mechanism.
Figure 17:
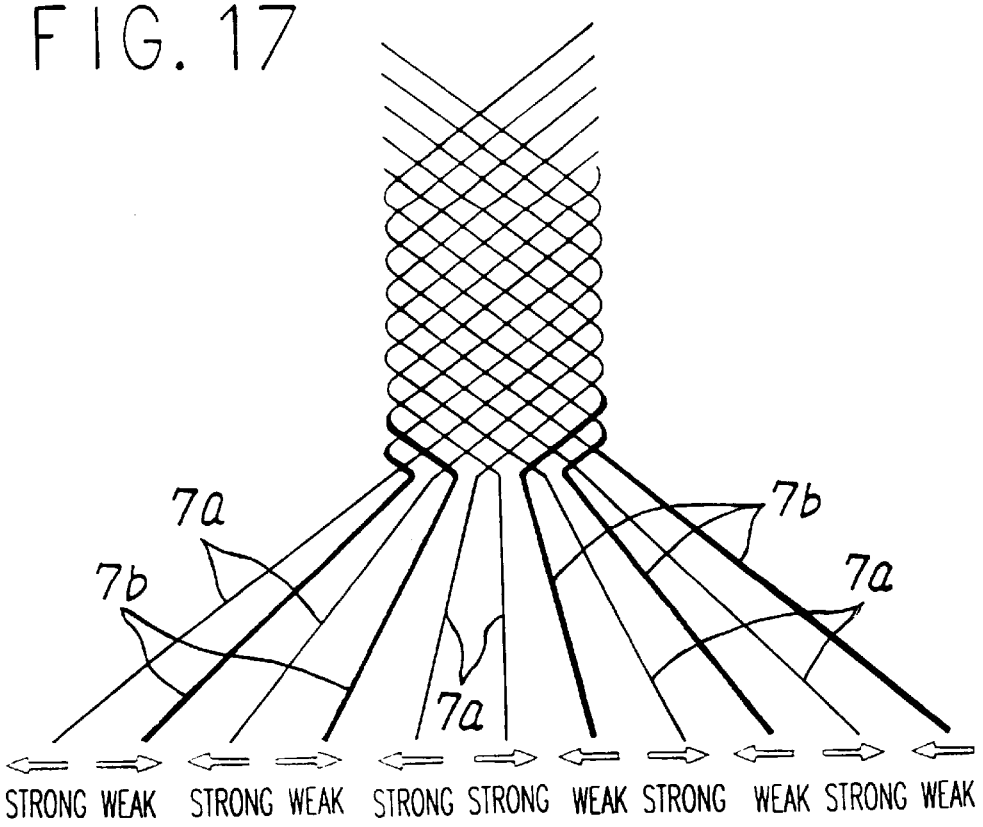
FIG. 17 is a diagrammatic illustration explanatory of the relationship between yarns and fabric being woven on a braid type three-dimensional textile weaving machine.

Illustrated in FIG. 8 is another embodiment of the detachable joint structure for the support member 30. The joint structure includes a U-shaped support member 55 which forms part of the support member 30 of the high tensioning mechanism 21 in the above-described embodiment. The support member 55 is provided with a socket cavity 56 for accommodation of the bobbin support shaft 26, and with E-shaped pin support holes 57 which are perforated in its opposite side walls 55*a* to receive therein an S-shaped resilient pin 58. A center portion 58*a* of the resilient pin 58 is resiliently displaceably bridged along one side of the socket cavity 56, the center portion 58*a* being engageable in a groove 59 which is formed at one side of a fore end portion of the bobbin support shaft 26 in such a way that the resilient pin 58 is resiliently pressed against the bobbin support shaft 26 within the groove 59.

Accordingly, in this case the resilient pin 58 is deformable in contrast to the joint structure of the foregoing embodiment employing the support shaft 26 which is unilaterally caused to deform at its head portion 26*a*. In this case, however, similarly the two parts can be connected with each other simply by pressing the socket cavity 56 on the pin support shaft 26.

Figure 4:
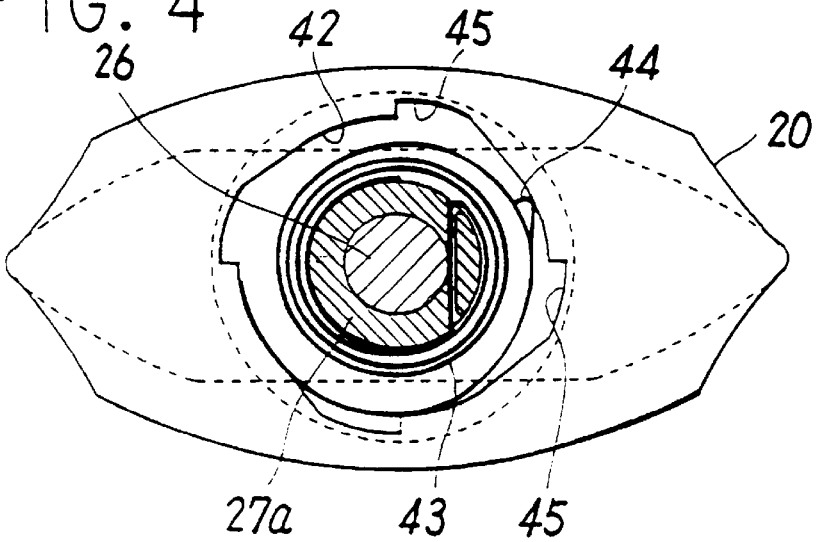
FIG. 4 is a transverse section showing a hook of the low tensioning mechanism in a disengaged state.

As shown in FIGS. 3 and 4, the spiral return spring 43 in the low tensioning mechanism 22 is fixedly connected at its inner end to the sleeve portion 27*a* of the bobbin connection member 27, and provided with a hook 44 at its outer end for engagement with one of notches 45 on the inner periphery of the spring chamber 42. The hook for this purpose may be a lancing hook 61 which is formed in the return spring 43 as shown particularly in FIG. 9.

Figure 10:
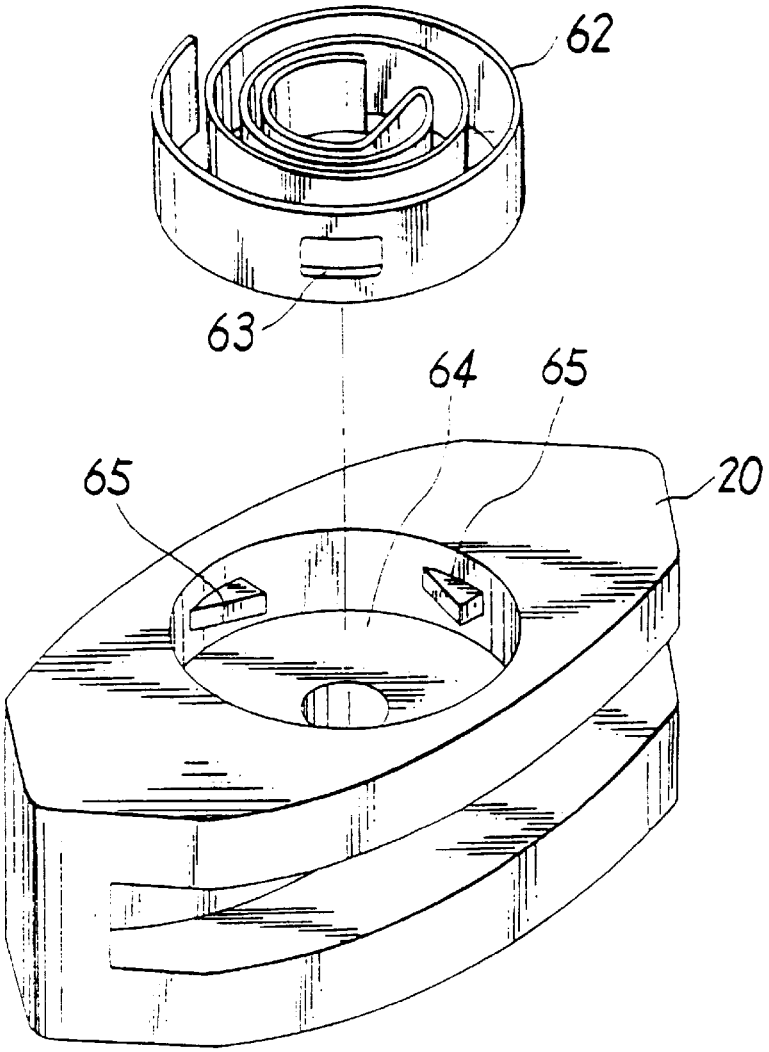
FIG. 10 is an exploded perspective view of a low tensioning mechanism of modified construction.

Further, as shown in FIG. 10, there may be employed a spiral return spring 62 of a shape similar to the above-described spiral return spring 43, the return spring 62 having an opening 63 for engagement with one of hooks 65 which are provided on the inner periphery of the spring chamber 64. In this case, the low tensioning mechanism operates in the same manner as in the foregoing embodiment. In any case, it suffices as long as male and female coupling members are provided on an outer end portion of the return spring 43 or 62 and on the inner periphery of the spring chamber 42 or 64 in such a way that they are disengaged from each other when the return spring is wound up tightly into a smaller diameter and engaged with each other again upon the return spring recoiling into a larger diameter in relation with a yarn rewinding operation.

As the return spring 43 or 62 is wound up by rotation of the sleeve portion 27*a* of the bobbin connecting member 27 which is connected to a the inner end of the return spring, it is desirable, for implementing the yarn draw-back capacity of the return spring, that the return spring be caused firstly to expand in diameter, holding its outermost loop in intimate contact with the inner periphery of the spring chamber 42 or 64, and then to contract gradually from inner to outer loops, finally disengaging from each other the male and female coupling members on the outer end of the return spring and the inner periphery of the spring chamber. This is because, in case the diameter of the return spring as a whole is reduced upon rotation of the sleeve portion 27*a* of the bobbin connecting member 27, there is a possibility of the male and female coupling members being disengaged from each other prematurely before the return spring is wound up to a predetermined degree.

This problem can be solved by varying the rigidity of the return spring, that is to say, by increasing the rigidity from inner to outer loops of the spring as will be described below with reference to FIGS. 11A to 11C.

Figure 11A:
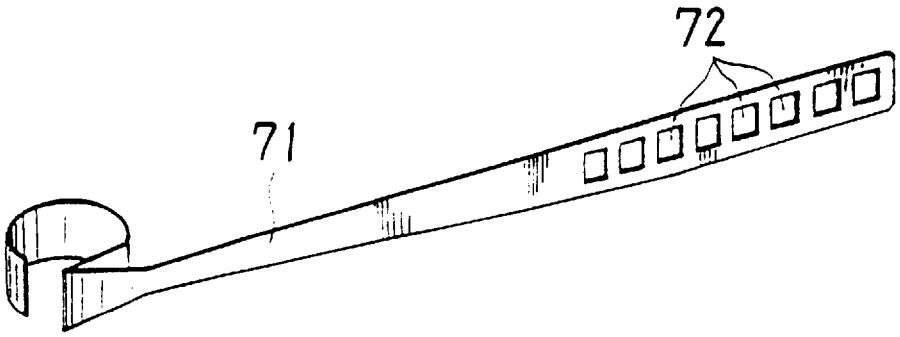
FIGS. 11A to 11C are perspective views of return springs of modified constructions for the low tensioning mechanism.
Figure 11B:
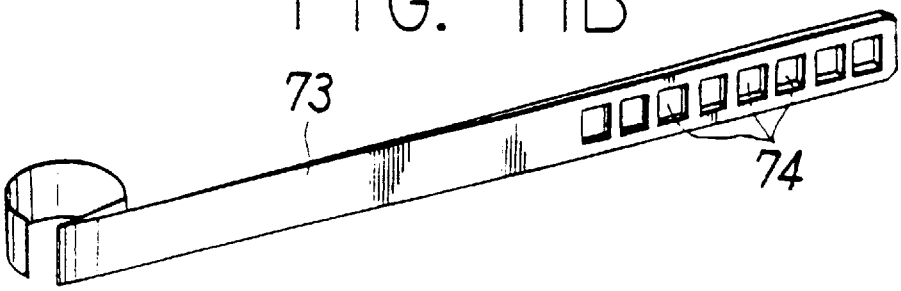

Illustrated in FIGS. 11A and 11B are basic arrangements of the return spring which can serve for this purpose. More specifically, FIG. 11A shows a return spring 71 in the form of a leaf spring which is uniform in thickness but varied in width in such a way that its width becomes narrower toward its base end (the inner winding end) and broader toward the outer end for the purpose of imparting lower rigidity to inner loops and higher rigidity to outer loops of the return spring. A large number of coupling apertures 72 are perforated in a row in an outer end portion of the return spring 71 for engagement with projections which are formed correspondingly in a row on the part of the spring chamber as will be described hereinlater with reference to FIG. 12. FIG. 11B shows a return spring 73 in the form of a leaf spring which is uniform in width and varied in thickness in such a manner that its thickness becomes smaller toward its base end and greater toward its outer end to impart a lower rigidity to inner loops and a higher rigidity to outer loops of the spirally coiled spring. Similarly, a large number of coupling apertures 74 are formed in a row in an outer end portion of the return spring 73 for engagement with coupling projections on the part of the spring chamber.

Figure 11C:
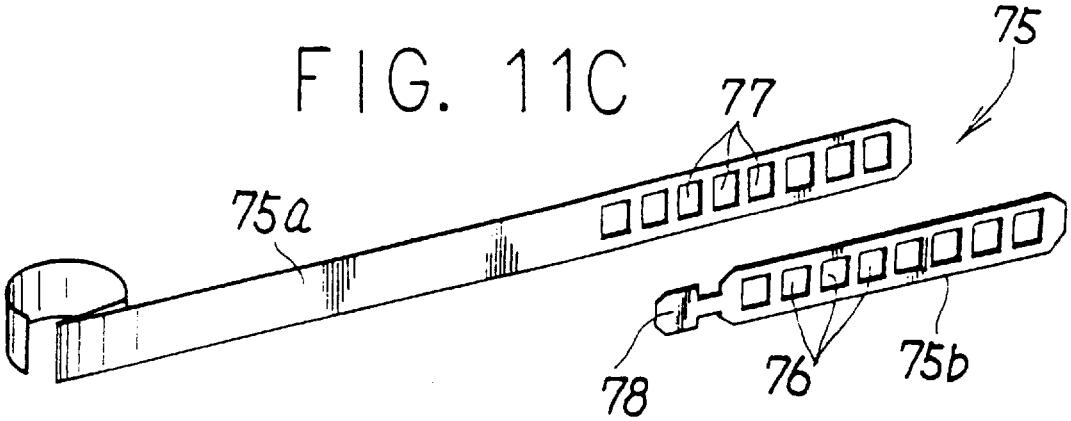
Figure 12:
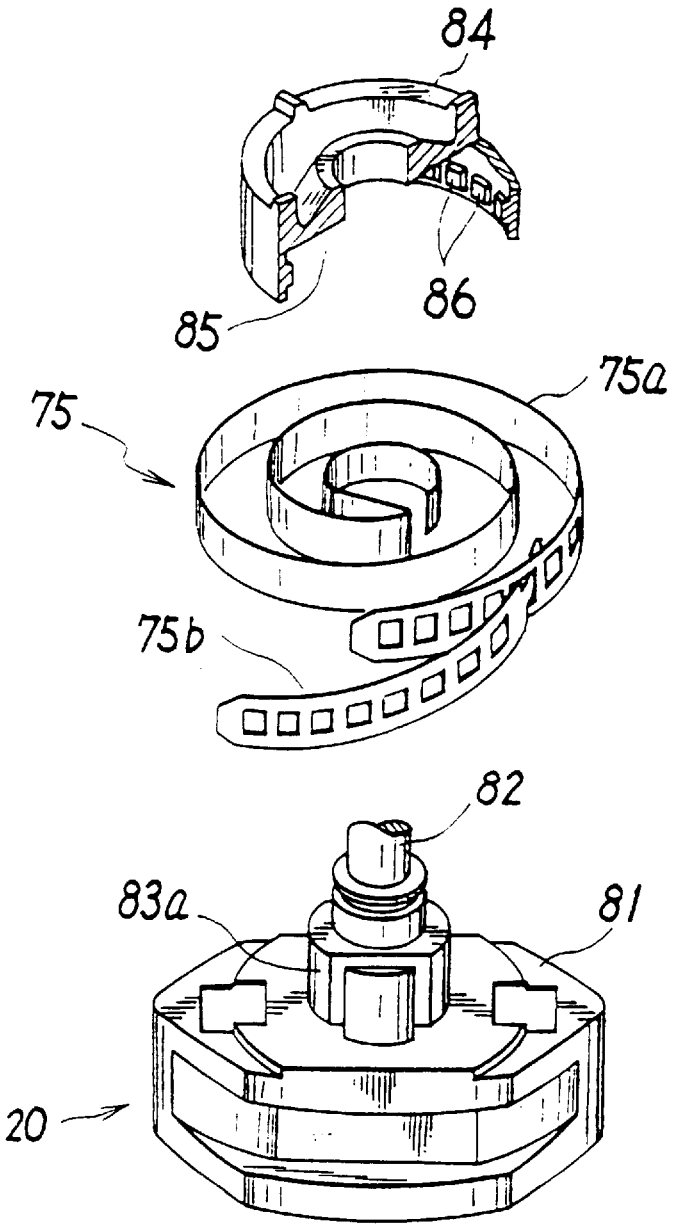
FIG. 12 is an exploded perspective view of a low tensioning mechanism incorporating the return spring of FIG. 11C.

Further, FIGS. 11C and 12 shows a return spring 75 constituted by an inner spring 75*a* with a lower rigidity and an outer spring 75*b* with a higher rigidity, which are connected end to end in such a manner as to form loops of lower rigidity on the inner side and loops of higher rigidity on the outer side when wound in a spiral form. The outer spring 75*b* is provided with a row of coupling apertures 76 for engagement with projections on the part of the spring chamber. Further, the outer spring 75*b* is provided with an interlocking portion 78 at its base end for interlocking engagement with one of apertures 77, which are formed in a row in an outer end portion of the inner spring member 75*a*. This arrangement permits to adjust the length of the return spring as a whole, in addition to variations in rigidity between the inner and outer loops of the spring. If desired, the inner and outer springs 75*a* and 75*b* may be connected to each other by welding or other arbitrary means.

Illustrated in FIG. 12 is a low tensioning mechanism incorporating the return spring 75 of FIG. 11C in association with a bobbin support shaft 82 which is erected on a carrier body 81 which constitutes the carrier 20. A sleeve portion 83*a* of a bobbin connecting member 83 is rotatably mounted on the bobbin support shaft 82. The return spring 75 is accommodated in a spring chamber 85 which is defined between the carrier body 81 and a casing 84 which is fixedly mounted on the carrier body 81. The return spring 75 is connected to the sleeve portion 83*a* at the base end of the inner spring member 75*a* and wound in a spiral form with the outer spring 75*b* of higher rigidity, which is connected of the outer end of the inner spring member 75*a*, pressed against the inner periphery of the spring chamber 85. The coupling apertures 76 which are formed in a row in the outer spring member 75*b* are engaged with coupling projections 86 of truncated pyramid shape which are formed on the inner periphery of the spring 85 in the same pitch as the coupling apertures 76.

Therefore, similarly to the embodiment shown in FIGS. 1 through 4, on winding off the yarn, the sleeve portion 83*a* is rotated together with the bobbin through the bobbin connecting member, which is not shown, as a result winding up the return spring 75 into a smaller diameter. As soon as the return spring 75 is wound up to a limit point, the coupling apertures 76 on the outer spring member 75*b* are disengaged from the coupling projections 86 on the inner periphery of the spring chamber 85, so that the return spring 75 is allowed to turn in the recoiling direction by its own biasing force. As a result, the return spring 75 expands into a larger diameter by the recoiling action, shifting the couplign apertures 76 of the outer spring member 75*b* by one pitch and again urging them into engagement with ensuing coupling projections to restore the original state of the return spring with a slight drop in its biasing force.

In this instance, since the return spring consists of a combination of the inner spring member 75*a* of the lower rigidity and the outer spring member 75*b* of higher rigidity as described hereinbefore, the loops of the inner spring member 75*a* of lower rigidity are deformed into a smaller diameter relatively easily upon winding up the return spring while the loops or loop of the outer spring member 75*b* of higher rigidity begins to undergo the deformative contraction in diameter only after the force from the inner spring member 75*a* has been magnified to a certain degree. Therefore, it is after the return spring 75 as a whole has been tightened into a compact form that the coupling apertures in the outer spring member 75*b* are shifted by one pitch in the bobbin rotating direction and engaged with ensuing coupling projections 86 thereby maintaining the biasing force of the return spring substantially at a constant level in a stable manner.

Figure 13:
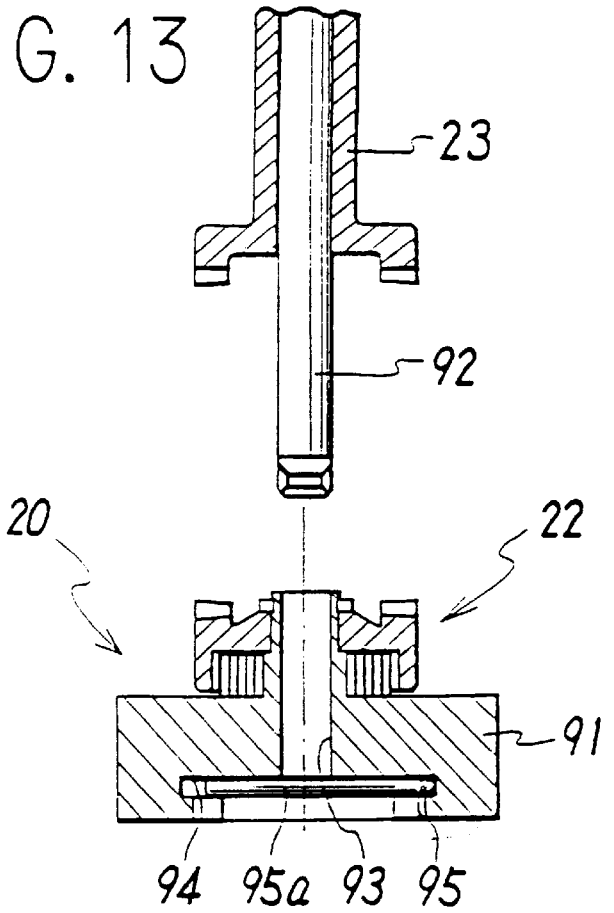
FIG. 13 is a sectional view of a bobbin support shaft detachably planted on a yarn carrier.

In the above-described embodiment, as shown particularly in FIGS. 1, 7A to 7C and 8, the bobbin 23 is rotatably fitted on the bobbin support shaft 26 which is fixedly erected at the center of the carrier 20, and the support member 30 of the high tensioning mechanism 21 is detachably mounted on an upper end portion of the bobbin support shaft 26. Alternatively, the bobbin support shaft 26 may be erected non-rotatably and detachably at the center of the carrier 20 as in further embodiments of the invention shown in FIGS. 13 to 15, permitting to remove the bobbin 23 from the carrier 20 together with the bobbin support shaft 26 and the support member of the high tensioning mechanism. In FIG. 13, although the construction of the high tensioning mechanism including its support member and the joint structure to the bobbin support shaft is omitted from illustration, it is to be understood that the embodiment of this figure is arranged substantially in the same manner as in the foregoing embodiments except that the support member and the bobbin support shaft are fixedly connected to each other.

Figure 14:
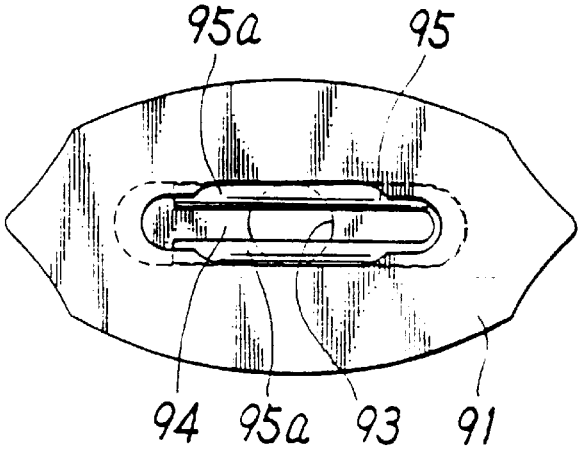
FIG. 14 is a bottom view of the yarn carrier.
Figure 15:
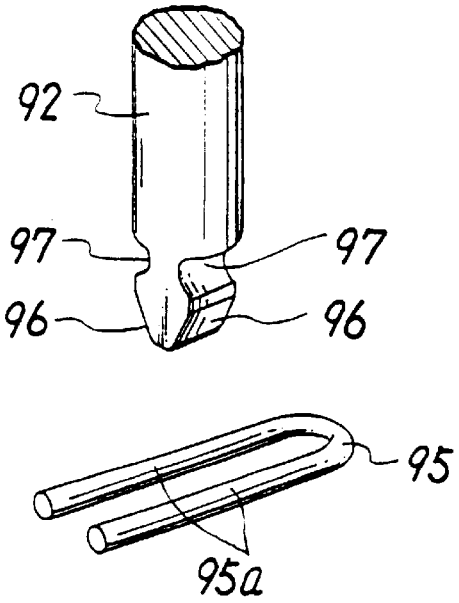
FIG. 15 is an fragmentary exploded view of the bobbin support shaft, showing a joint structure which couples same with the carrier.
Figure 16:
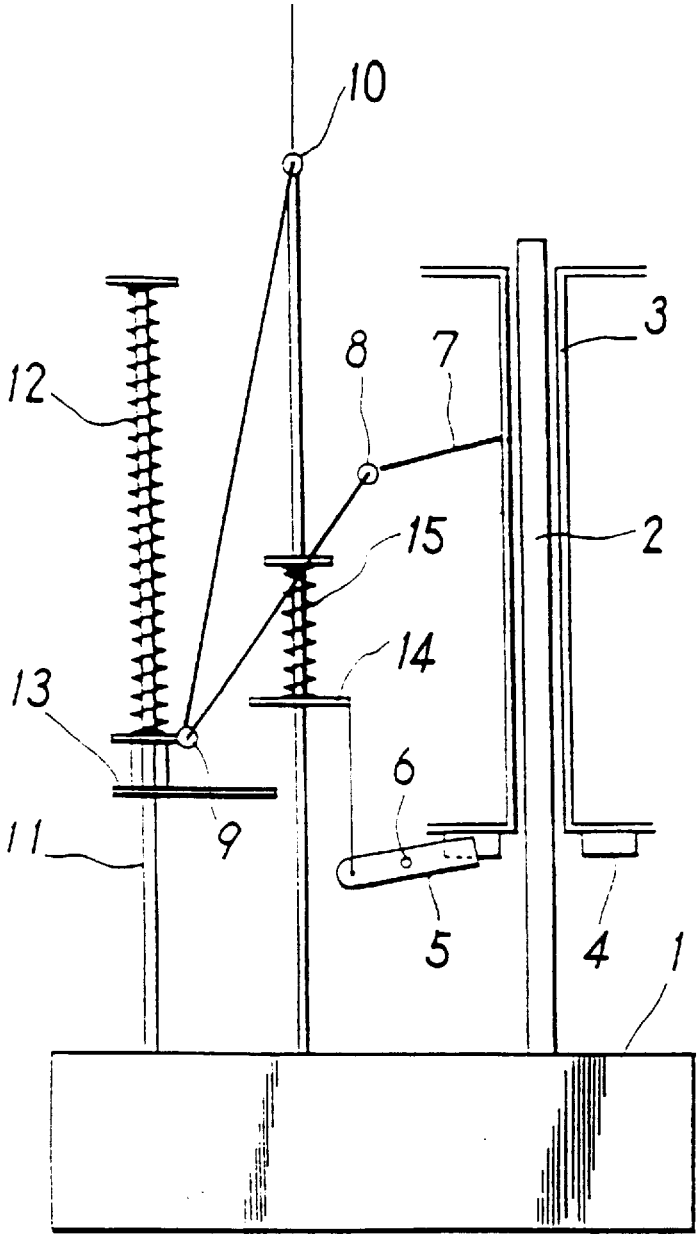
FIG. 16 PRIOR ART
FIG. 16 is a schematic view of a conventional yarn tensioning device in general use.

More specifically, in the embodiments of FIGS. 13 to 15, a carrier body 91 which constitutes the afore-mentioned carrier 20 is internally provided with a receptacle bore 93 for detachably receiving a bobbin support shaft 92 therein. Formed around the bore 93 on the bottom side of the carrier body 91 is an oblong groove 94 with laterally caved-in end portions. A U-pin 95 which is folded in the shape of the letter "U" is fitted in the groove 94 with its legs 95*a* bridged on the opposite sides of the receptacle bore 94 in a securely anchored state to prevent its dislocation from the groove 94. On the other hand, the bobbin support shaft 92 is provided with a tapered foot portion at its lower end, the foot portion being tapered on its opposite lateral sides 96 for spreading apart the leg portions 95*a* of the U-pin 95, and with recesses 97 which are formed immediately behind the tapered portions 96 to receive the leg portions 95*a* of the U-pin 95 which has overridden the tapered foot portion 96. When the bobbin support shaft 92 is set in position, the leg portions 95*a* of the U-pin 95 hold the bobbin support shaft 92 in a resiliently pressed state within the recesses 97. The low tensioning mechanism 22 of this embodiment is arranged substantially in the same manner as in FIG. 12 in construction.

With the above-described arrangements, the bobbin 23 can be removed from the carrier 20 together with the bobbin support shaft 92 and the support member of the high tensioning mechanism easily in a preparatory stage of a weaving operation or at the time of bobbin replacement to facilitate the yarn threading through the respective yarn guides. On such an occasion, if the bobbin 23 is retained on the bobbin support shaft 92, the yarn preparing operation can be facilitated all the more.

What is claimed is:

1. A yarn tensioning device for a textile weaving machine of the type which is arranged to weave a three-dimensional fabric by interweaving a number of yarns fed from a corresponding number of yarn carriers, said yarn carriers being driven by a carrier drive mechanism to shift the respective positions along predetermined loci of movements within a common carrier shifting plane, said yarn tensioning device comprising:

a high tensioning mechanism mounted on each one of said yarn carriers and arranged to act with a small yarn drawback capacity and a high yarn tensioning capacity relative to a feed yarn being withdrawn from a bobbin on said carrier to impart a high unwinding tension thereto; and a low tensioning mechanism mounted between said carrier and bobbin and arranged to act with a large yarn drawback capacity and a low yarn tensioning capacity relative to the bobbin through a rotational coupling therewith;

said high tensioning mechanism being adapted to impart a high tension to said feed yarn being withdrawn from the bobbin in a yarn draw-out phase of operation; and said low tensioning mechanism being adapted to take over from said high tensioning mechanism to impart a low tension to the feed yarn being rewound onto the bobbin in a yarn draw-back phase of operation at a limit point of yarn draw-back by said high tensioning mechanism to take up any slack remaining in the feed yarn after drawback by said high tension mechanism;

wherein said low tensioning mechanism is constituted by:

a bobbin support shaft;

a spring chamber formed around said bobbin support shaft on said yarn carrier; and a spiral return spring accommodated in said spring chamber and having the inner end thereof fexedly secured to a bobbin connecting member rotatably fitted on a bobbin support shaft and the outer end held in engagement with the inner periphery of said spring chamber through male and female coupling members to be disengaged from each other when said spiral return spring is wound up into a smaller diameter beyond a predetermined limit point and engaged with each other again upon said spiral recoiling into a larger diameter;

wherein said spiral return spring is arranged to have a relatively low rigidity in inner loops thereof and a relatively high rigidity in an outer loop or loops thereof.

2. A yarn tensioning device as defined in claim 1, wherein said spiral return spring is constituted by an inner spring member of lower rigidity and an outer spring member of higher rigidity connected to the outer end of said inner spring member.

* * * * *